US006752656B2

(12) United States Patent
Ho

(10) Patent No.: US 6,752,656 B2
(45) Date of Patent: Jun. 22, 2004

(54) ELECTRICAL CONNECTOR WITH STAGGERED SECURING ELEMENTS

(75) Inventor: Yi-Tse Ho, Tainan Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/269,489

(22) Filed: Oct. 11, 2002

(65) Prior Publication Data

US 2003/0077938 A1 Apr. 24, 2003

(30) Foreign Application Priority Data

Oct. 18, 2001 (TW) ..... 90217801 U

(51) Int. Cl.[7] ..... H01R 13/60; H01R 13/66
(52) U.S. Cl. ..... 439/567; 439/571
(58) Field of Search ..... 439/567, 570, 439/571, 572, 573, 378

(56) References Cited

U.S. PATENT DOCUMENTS 5,171,165 A * 12/1992 Hwang ..... 439/567
5,184,963 A * 2/1993 Ishikawa ..... 439/79
5,257,948 A * 11/1993 Peterson ..... 439/571
6,000,965 A * 12/1999 Hsiao et al. ..... 439/567
6,024,602 A * 2/2000 Mchugh et al. ..... 439/567
6,050,850 A * 4/2000 Crane et al. ..... 439/569
6,345,992 B1 * 2/2002 Cheong et al. ..... 439/83
6,354,875 B1 * 3/2002 Wu ..... 439/607
6,454,599 B1 * 9/2002 Wu ..... 439/567
6,494,751 B1 * 12/2002 Morello et al. ..... 439/752
6,517,252 B2 * 2/2003 Yamaguchi ..... 385/53
6,540,553 B1 * 4/2003 Wu ..... 439/567
6,572,404 B1 * 6/2003 Wu ..... 439/567
6,589,074 B1 * 7/2003 Wu ..... 439/540.1
6,589,077 B1 * 7/2003 Wu ..... 439/567

* cited by examiner

*Primary Examiner*—Hae Moon Hyeon
(74) *Attorney, Agent, or Firm*—Robert J. Zeitler

(57) ABSTRACT

This invention provides an electrical connector, which includes an insulating base, a plurality of conductive terminals and two securing elements so as to electrically connect and secure to a circuit board for coupling with a matching electrical connector. The insulating base has a body and a connecting portion connected to one side of the body. The body has a coupling face, a first face and a second face disposed adjacent to two opposite lateral edges of the coupling face, and two positioning grooves disposed at two opposite end portions of the body and sunken toward the second face relative to the first face. The securing element has a connecting end and a securing end. The connecting ends of the securing elements are respectively fitted in the positioning grooves such that the securing end of each securing element is exposed from the coupling face of the insulating base. Due to the difference in depths of the positioning grooves in the insulating base, the securing ends of the securing elements and the first face of the insulating base are spaced apart by different distances, thereby achieving an effect of staggering of the securing ends relative to each other.

4 Claims, 3 Drawing Sheets

PRIOR ART

ELECTRICAL CONNECTOR WITH STAGGERED SECURING ELEMENTS

FIELD OF THE INVENTION

This invention relates to an electrical connector, more particularly to an electrical connector having securing elements that are arranged in non-symmetrical form.

BACKGROUND OF THE INVENTION

FIG. 1 is a schematic view of an electrical connector 1 and a circuit board 2 in an assembled state. The electrical connector 1 includes an insulating base 10, a plurality of conductive terminals 11 received in the insulating base 10 and two securing elements 12 positioned on the insulating base 10. The insulating base 10 has a body 100, an insert portion 101 connected to one side of the body 100 for coupling with a matching electrical connector (not shown), and a coupling face 102 disposed on the other side of the body 100 opposite to the insert portion to contact the circuit board 2. The conductive terminal 11 has a contact end 111 and a coupling end 112 opposite to the contact end 111 such that the contact end can be exposed from the insert portion 101 and that the coupling end 112 projects and exposed from the coupling face 102. Further, two securing elements 12 are respectively disposed on two symmetrical sides of the coupling face 102 of the body 100 and project outwardly from the coupling face 102. During assembly of the electrical connector 1 and the circuit board 2, the circuit board 2 is provided with solder holes 21 corresponding in position to the coupling ends 112 of the conductive terminals 11, respectively, and securing holes 22 corresponding in position to the securing elements 12, respectively. By inserting the coupling ends 112 of the conductive terminals of the electrical connector 1 into the solder holes 21 in the circuit board 2, and by inserting the securing elements 12 of the electrical connector 1 into the securing holes 22 in the circuit board 2, after furnace reflow, electrical connection and securing of the electrical connector 1 and the circuit board 2 can be simultaneously achieved.

However, since the molding device, process, assembly, etc., employed by the conventional electrical connector 1 are fixed, in particular the securing elements 12 are generally mounted on the insulating base 10 in the same manner as the conductive terminals 11 and are arranged on the coupling face 102 of the insulating base 10 in a symmetrical manner, i.e., the imaginary line 13 of the two securing elements 12 is generally parallel to an axis 14 passing through the coupling face 102 of the insulating base 10. However, in case there is a special specification requirement for the securing elements 12 to be offset from the insulating base 10 in a non-symmetrical manner, due to the many factors involved in the manufacturing process, e.g., specially made molding devices and processes for particular specifications, the costs of manufacturing such type of electrical connectors will be considerably increased. Besides, the design is directed to the specification of only a single electrical connector, and there is a lack of flexibility in application.

SUMMARY OF THE INVENTION

Therefore, the main object of the present invention is to provide an electrical connector structure that includes securing elements in a staggered arrangement, and that can adapt to produce an arrangement of securing elements with different amounts of staggering to thereby provide flexibility in application, without the need to considerably modify the molding device and manufacturing process.

Accordingly, the electrical connector of the present invention includes an insulating base, a plurality of conductive terminals and two securing elements so as to electrically connect and secure to a circuit board for coupling with a matching electrical connector.

The insulating base has a body and a connecting portion connected to one side of the body to contact a matching electrical connector. The body has a coupling face disposed proximate to the circuit board, a first face and a second face disposed adjacent to two opposite lateral edges of the coupling face, and two positioning grooves disposed in two opposite end portions of the body and sunken toward the second face relative to the first face such that the positioning grooves are respectively formed with insert slots in the first face, and the depths of the two positioning grooves that are sunken from the first face toward the second face differ by a certain distance.

The conductive terminal has a contact end and a coupling end. Each of the conductive terminal is positioned in the insulating base such that the contact end is disposed on the connecting portion of the insulating base to electrically contact the matching electrical connector and that the coupling end is exposed from the coupling face of the insulating base to electrically connect with corresponding contacts on the circuit board.

The securing element has a connecting end and a securing end opposite to the connecting end. The connecting end of each securing element enters via the insert slot in the insulating base to fit into the positioning groove such that the securing end of each securing element is exposed from the coupling face of the insulating base to secure to the circuit board. Since the relative depths of the positioning grooves in the insulating base are different, the securing ends of the securing elements and the first face of the insulating base are spaced apart by different distances so that an imaginary connecting line connecting the securing ends of the two securing elements extends in a direction different from an extending direction of the first face, thereby achieving an effect of staggering of the securing ends of the two securing elements relative to each other.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
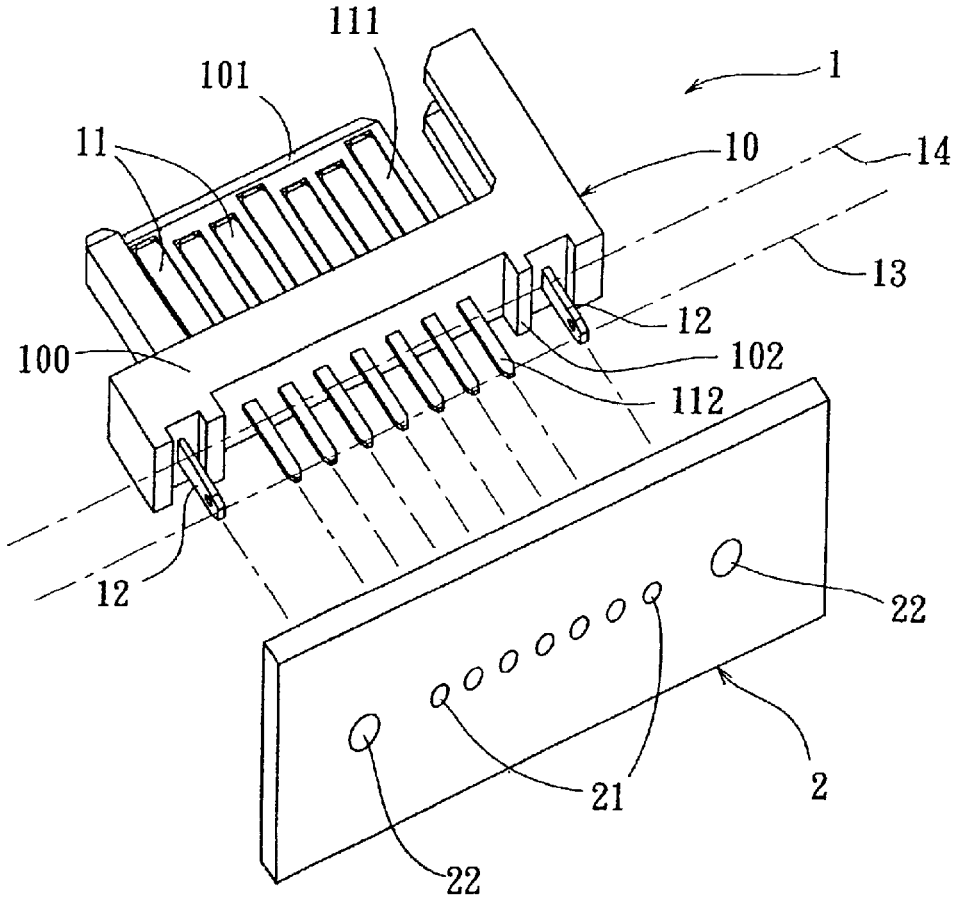
FIG. 1 is a schematic view of the structure of a conventional electrical connector, illustrating its assembly relationship with a circuit board.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
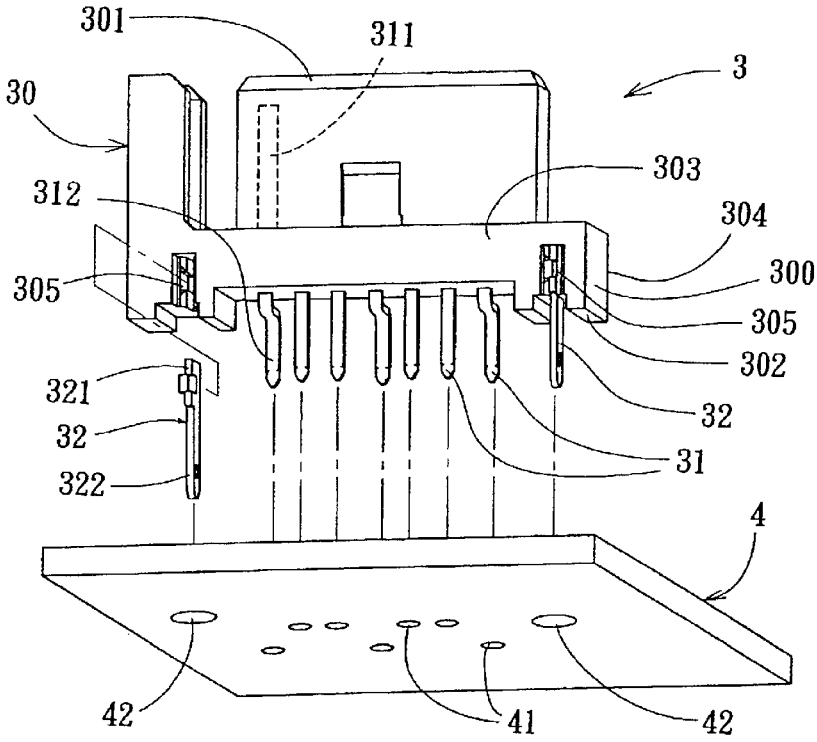
FIG. 2 is a schematic view of the structure of a preferred embodiment of an electrical connector according to the present invention, illustrating its assembly relationship with a circuit board.

Referring to FIG. 2, a preferred embodiment of an electrical connector 3 according to the present invention is shown to include an insulating base 30, a plurality of conductive terminals 31 and two securing elements 32 such that the electrical connector 3 can be connected electrically and secured to a circuit board 4 for coupling with a matching electrical connector (not shown).

Figure 3:
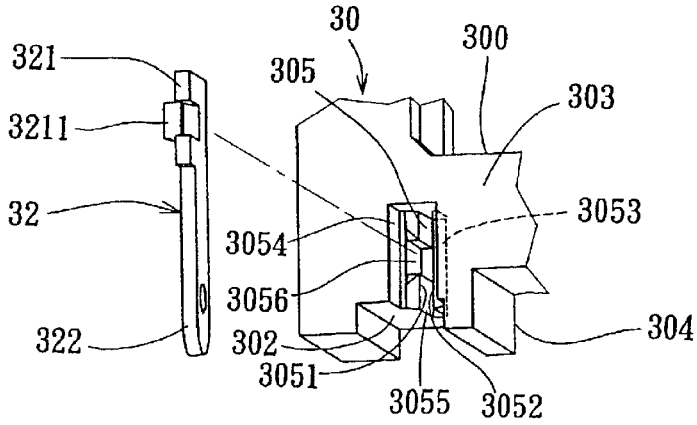
FIG. 3 is a schematic, partly enlarged assembled view of an insulating base and a securing element of the preferred embodiment.
Figure 5:
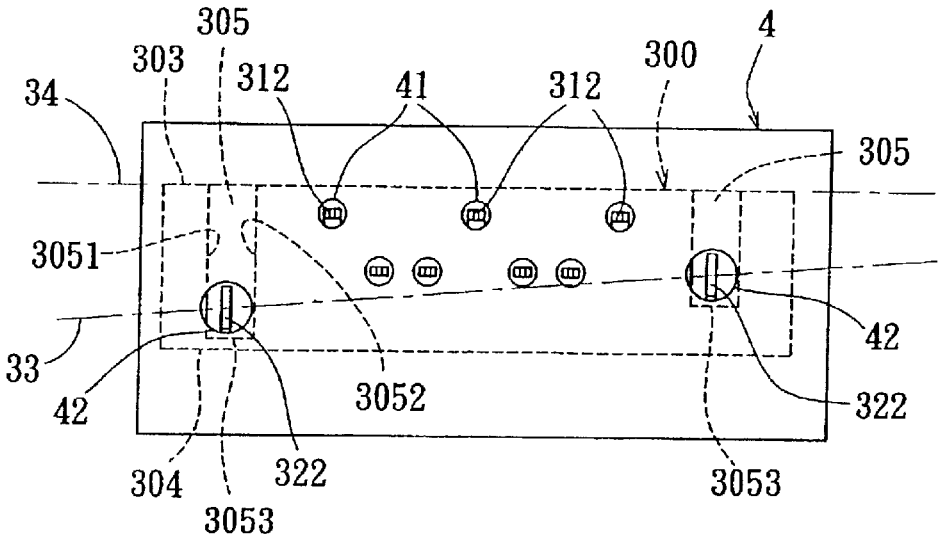
FIG. 5 is a bottom view taken from a bottom side of the circuit board after assembly of the preferred embodiment with the circuit board.

The insulating base 30 has a body 300 and an insert portion 301 connected to one side of the body 300 and projecting therefrom to contact the matching electrical connector. The body 300 has a coupling face 302 proximate to the circuit board 4, a first face 303 and a second face 304 disposed adjacent to two opposite lateral edges of the coupling face 302, respectively, and two positioning grooves 305 disposed on two opposite end portions of the body 300 and sunken toward the second face 304 relative to the first face 303. The coupling face 302 is disposed on the other side of the body 300 opposite to the insert portion 301. Referring further to FIG. 3, the positioning grooves 305 are defined by a bottom wall surface 3053 that sinks into the body 300 relative to the first face 303, and a first side wall surface 3051 and a second side wall surface 3052 disposed adjacent to two opposite sides of the bottom wall surface 3053, respectively. Each positioning groove 305 forms an insert slot 3054 in the first face 303, and forms an opening 3055 in the coupling face 302. In addition, as shown in FIG. 5, the two positioning grooves 305 are sunken from the first face 303 toward the second face 304 to depths that differ by a certain distance. The first side wall surface 3051 is further provided with a retaining portion 3056 that is sunken relative to the first side wall surface 3051.

The conductive terminal 31 has a contact end 311 and a coupling end 312. Each conductive terminal 31 is positioned in the insulating base 30 such that the contact end 311 is disposed on the insert portion 301 of the insulating base 30 to electrically contact the electrical connector. The coupling end 312 projects from the coupling face 302 of the insulating base 10 to electrically connect with the circuit board 4.

Figure 4:
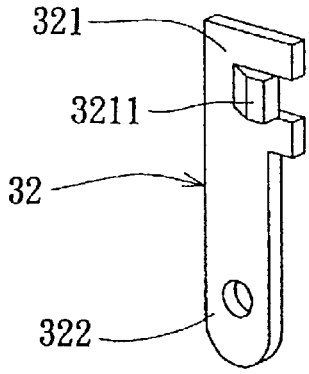
FIG. 4 is a schematic view of the securing element of the preferred embodiment taken from another angle.

With reference to FIGS. 3 and 4, the securing element 32 has a connecting end 321 and a securing end 322 opposite to the connecting end 321. The connecting end 321 of the securing element 32 is provided with a retaining projecting block 3211 corresponding in position to the retaining portion 3056.

During assembly, as shown in FIGS. 2 and 3, the connecting end 321 of each securing element 32 enters through the insert slot 3054 in the insulating base 30. The securing end 322 of each securing element 32 is exposed from the coupling face 302 of the insulating base 30 via the opening 3055. By means of the retaining projecting block 3211 that can fit into the retaining portion 3056 to generate interference, the connecting end 321 of the securing element 32 can be inserted into the positioning groove 305 to be positioned therein such that the securing element 32 will not slip from the positioning groove 305 via the opening 3055. Referring further to FIG. 5, since the two positioning grooves 305 in the insulating base 30 have different depths relative to the first face 303, i.e., the bottom wall surface 3053 of each positioning groove 305 has a different height relative to the first face 303. When the connecting end 321 of the securing element 32 is inserted into the positioning groove 305 via the insert slot 3054 to contact the bottom wall surface 3053 of the positioning groove 305, the securing ends 322 of the two securing elements 32 are spaced apart from the first face 303 of the insulating base 30 by different distances. Therefore, when the electrical connector 3 is assembled to the circuit board 4, an imaginary connecting line 33 connecting the securing ends 322 of the two securing elements 32 will not be parallel to an extending direction 34 of the first face 303 of the insulating base 30 because the positioning grooves 305 have varying depths, which is different from the conventional electrical connector having the design of symmetrical securing elements, thereby achieving the effect of staggering of the securing end 322 of the two securing elements 32. Hence, the coupling ends 312 of the conductive terminals 31 of the electrical connector 3 and the securing ends 322 of the securing elements 32 can be inserted respectively into the solder holes 41 and the securing holes 42 in the circuit board 4 to thereby establish connection. An advantage of such a design is that, by varying the depths of the positioning grooves 305 relative to the first face 303, the securing ends 322 of the securing elements 32 can be staggered apart at different distances. Thus, without the need to modify the manufacturing process considerably, the specification requirement that the securing ends 322 of the securing elements 32 have different amounts of staggering can be accommodated.

While a preferred embodiment of the present invention is shown and described, it is envisioned that those skilled in the art may devise various modifications of the present invention without departing from the spirit and scope of the appended claims.

What is claimed is:

1. An electrical connector, which is electrically connected and secured to a circuit board for coupling with a matching electrical connector, the electrical connector comprising:

an insulating base having a body and an insert portion connected to one side of the body to contact the matching electrical connector, the body having a coupling face disposed proximate to the circuit board, a first face and a second face disposed adjacent to two opposite lateral edges of the coupling face, respectively, and two positioning grooves disposed on two opposite end portions of the body and sunken toward the second face relative to the first face such that each of the positioning grooves forms an insert slot in the first face, depths of the two positioning grooves that are sunken from the first face toward the second face being different by a certain distance;

a plurality of conductive terminals, each of the conductive terminals having a contact end and a coupling end, each of the conductive terminals being positioned in the insulating base such that the contact end can be disposed on the insert portion of the insulating base to electrically contact the matching electrical connector and that the coupling end is exposed from the coupling face of the insulating base to electrically connect with corresponding contacts on the circuit board; and two securing elements, each of the securing elements having a connecting end and a securing end opposite to the connecting end, the connecting ends of the securing elements entering via the insert slots in the insulating base to fit into the positioning grooves, respectively, such that the securing ends of the securing elements are exposed from the coupling face of the insulating base to be secured to the circuit board and that, due to the difference in relative depths of the positioning grooves in the insulating base, the securing ends of the securing elements and the first face of the insulating base are spaced apart by different distances so that an imaginary connecting line connecting the securing ends of the two securing elements extends in a direction which is different from an extending direction of the first face of the insulating base, thereby achieving an effect of staggering of the securing ends of the two securing elements relative to each other.

2. The electrical connector as claimed in claim 1, wherein each of the positioning grooves in the insulating base is defined by a bottom wall surface that is sunken into the body relative to the first face, and a first side wall surface and a second side wall surface disposed adjacent to two opposite sides of the bottom wall surface, respectively, the first side wall surface being further provided with a retaining portion that is recessed relative to the first side wall surface, the connecting end of the securing element being further provided with a retaining projecting block corresponding in position to the retaining portion, the retaining projecting block being received in the retaining portion to generate interference such that the securing element can be secured in the positioning groove.

3. The electrical connector as claimed in claim 2, wherein the positioning groove in the insulating base is formed with an opening in the coupling face such that the securing end of the securing element can pass through the opening to be exposed from the coupling face.

4. A housing for an electrical connector, comprising:

an insulating base having a body, the body having a coupling face for mounting on a circuit substrate, a first face and a second face disposed adjacent to two opposite lateral edges of the coupling face, respectively, and two positioning grooves disposed on two opposite end portions of the body and sunken toward the second face relative to the first face such that each of the positioning grooves forms an insert slot for receiving a securing element, the depths of the two positioning grooves that are sunken from the first face toward the second face being different.

* * * * *